US009815218B2

(12) United States Patent
Klingler

(10) Patent No.: US 9,815,218 B2
(45) Date of Patent: Nov. 14, 2017

(54) SLICER WITH PULSE-WIDTH MODULATION CONTROL UNIT

(75) Inventor: Holger Klingler, Haigerloch (DE)

(73) Assignee: BIZERBA GMBH & CO. KG, Balingen (DE)

( * ) Notice: Subject to any disclaimer, the term of this patent is extended or adjusted under 35 U.S.C. 154(b) by 136 days.

(21) Appl. No.: 13/816,499

(22) PCT Filed: Aug. 4, 2011

(86) PCT No.: PCT/EP2011/003915

§ 371 (c)(1),
(2), (4) Date: Feb. 12, 2013

(87) PCT Pub. No.: WO2012/019736

PCT Pub. Date: Feb. 16, 2012

(65) Prior Publication Data

US 2013/0133498 A1 May 30, 2013

(30) Foreign Application Priority Data

Aug. 13, 2010 (DE) ..... 10 2010 034 299

(51) Int. Cl.
*B26D 5/08* (2006.01)
*B26D 1/143* (2006.01)
(Continued)

(52) U.S. Cl.
CPC ..... *B26D 5/086* (2013.01); *B26D 1/143* (2013.01); *B26D 5/00* (2013.01); *B26D 5/20* (2013.01);
(Continued)

(58) Field of Classification Search
CPC ..... B26B 21/20; B26B 21/22; B26B 21/18; B26B 21/56; B26B 5/00; B26B 5/086;
(Continued)

(56) References Cited

U.S. PATENT DOCUMENTS 3,821,913 A * 7/1974 Bajcar ..... B26D 7/32 83/73
3,824,885 A * 7/1974 Marshall ..... B26D 7/30 83/176
(Continued)

FOREIGN PATENT DOCUMENTS

DE 3 304 218 A1 8/1984
DE 102007056393 A1 5/2009
(Continued)

*Primary Examiner* — Jason Daniel Prone
*Assistant Examiner* — Richard Crosby, Jr.
(74) *Attorney, Agent, or Firm* — Leydig, Voit & Mayer Ltd.

(57) ABSTRACT

A slicer for cutting slices of elongated food products includes a machine housing and a slicing blade that is held by the machine housing. An electric slicing motor drives the slicing blade, and a control unit actuates the slicing motor using a pulse-width modulation. The control unit includes a microcontroller and a motor output stage. The microcontroller is configured to generate pulse-width-modulated control signals by varying at least one of an amplitude, a frequency or a pulse width of the control signals and to forward the control signals to the slicing motor.

19 Claims, 2 Drawing Sheets

(51) Int. Cl.
*B26D 5/00* (2006.01)
*B26D 5/20* (2006.01)

(52) U.S. Cl.
CPC ..... *B26D 2210/02* (2013.01); *Y10T 83/8789* (2015.04)

(58) Field of Classification Search
CPC ..... B26B 5/08; B27B 5/07; B27B 19/006; B26D 2210/00; B26D 2210/02; B26D 7/0616; B26D 1/143
USPC ..... 30/351, 353, 355, 346.57, 392–394; 83/703, 707, 719, 720, 721, 730; 318/599, 811; 388/804, 811, 819, 829, 388/831
See application file for complete search history.

(56) References Cited

U.S. PATENT DOCUMENTS 3,855,889 A * 12/1974 Wiley ..... B26D 7/32 83/23
4,520,703 A 6/1985 Speckhart et al.
4,780,660 A * 10/1988 Shima et al. ..... 323/207
4,793,228 A * 12/1988 Etter ..... B26D 7/32 83/155.1
4,813,316 A * 3/1989 Johnson ..... B26D 7/0616 83/365
5,628,237 A * 5/1997 Lindee ..... B26D 1/0006 83/403.1
5,989,116 A * 11/1999 Johnson ..... B26D 1/0006 452/150
6,431,043 B1 * 8/2002 Niemann ..... B23D 47/12 83/477.2
7,048,676 B1 * 5/2006 Wu ..... A63B 22/0235 482/51
7,073,421 B1 * 7/2006 Verhalen ..... B24B 3/463 451/422
7,299,728 B2 * 11/2007 Ferrin ..... B26D 1/03 198/347.1
7,872,435 B2 * 1/2011 Imai ..... H02P 21/06 318/599
8,215,219 B2 * 7/2012 Rummel ..... B26D 5/26 83/13
2002/0149342 A1 * 10/2002 Nakata ..... H02P 6/002 318/801
2003/0079589 A1 * 5/2003 Kovacs ..... B26D 7/0616 83/42
2005/0045007 A1 * 3/2005 Mueller ..... 83/13
2005/0104552 A1 * 5/2005 Arai et al. ..... 318/801
2007/0013325 A1 * 1/2007 Kiuchi et al. ..... 318/34
2007/0199622 A1 8/2007 Gass et al.
2007/0223261 A1 * 9/2007 Fujii et al. ..... 363/55
2008/0250944 A1 * 10/2008 Pryor ..... B26D 7/27 99/537
2008/0303474 A1 * 12/2008 Pinard ..... G05B 19/4141 318/600
2009/0058334 A1 * 3/2009 Yamamoto ..... 318/400.02
2009/0120256 A1 * 5/2009 Pasek ..... B26D 5/32 83/446
2009/0193946 A1 * 8/2009 Bondarowicz ..... B26D 1/143 83/13
2009/0277343 A1 11/2009 Ghimire
2011/0056356 A1 3/2011 Koch et al.

FOREIGN PATENT DOCUMENTS

DE 102008024437 A1 11/2009
WO WO 2009 062 854 A1 5/2009

* cited by examiner

SLICER WITH PULSE-WIDTH MODULATION CONTROL UNIT

CROSS REFERENCE TO RELATED APPLICATIONS

This application is a U.S. National Phase application under 35 U.S.C. §371 of International Application No. PCT/EP2011/003915, filed on Aug. 4, 2011, and claims benefit to German Patent Application No. DE 10 2010 034 299.8, filed on Aug. 13, 2010. The International Application was published in German on Feb. 16, 2012, as WO 2012/019736 A1 under PCT Article 21 (2).

FIELD

The invention relates to a slicer for cutting slices of elongated food products.

BACKGROUND

In actual practice, such slicers are used, for example, to cut food such as cold cuts or fish at points of sale for fresh food. Here, the slicers are driven by an electric motor that is adapted to the network voltage on site. Furthermore, if the slicers are used continuously, they can generate an excessive heat load as a result of the heating up of the motor, which is undesired, especially in the case of food that is supposed to be processed at cool temperatures.

SUMMARY

An aspect of the present invention is to provide a slicer whose drive has a low heat output and that can be connected to different power networks.

In an embodiment, the present invention provides a slicer for cutting slices of elongated food products. The slicer includes a machine housing and a slicing blade that is held by the machine housing. An electric slicing motor drives the slicing blade, and a control unit actuates the slicing motor using a pulse-width modulation. The control unit includes a microcontroller and a motor output stage. The microcontroller is configured to generate pulse-width-modulated control signals by varying at least one of an amplitude, a frequency or a pulse width of the control signals and to forward the control signals to the slicing motor.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
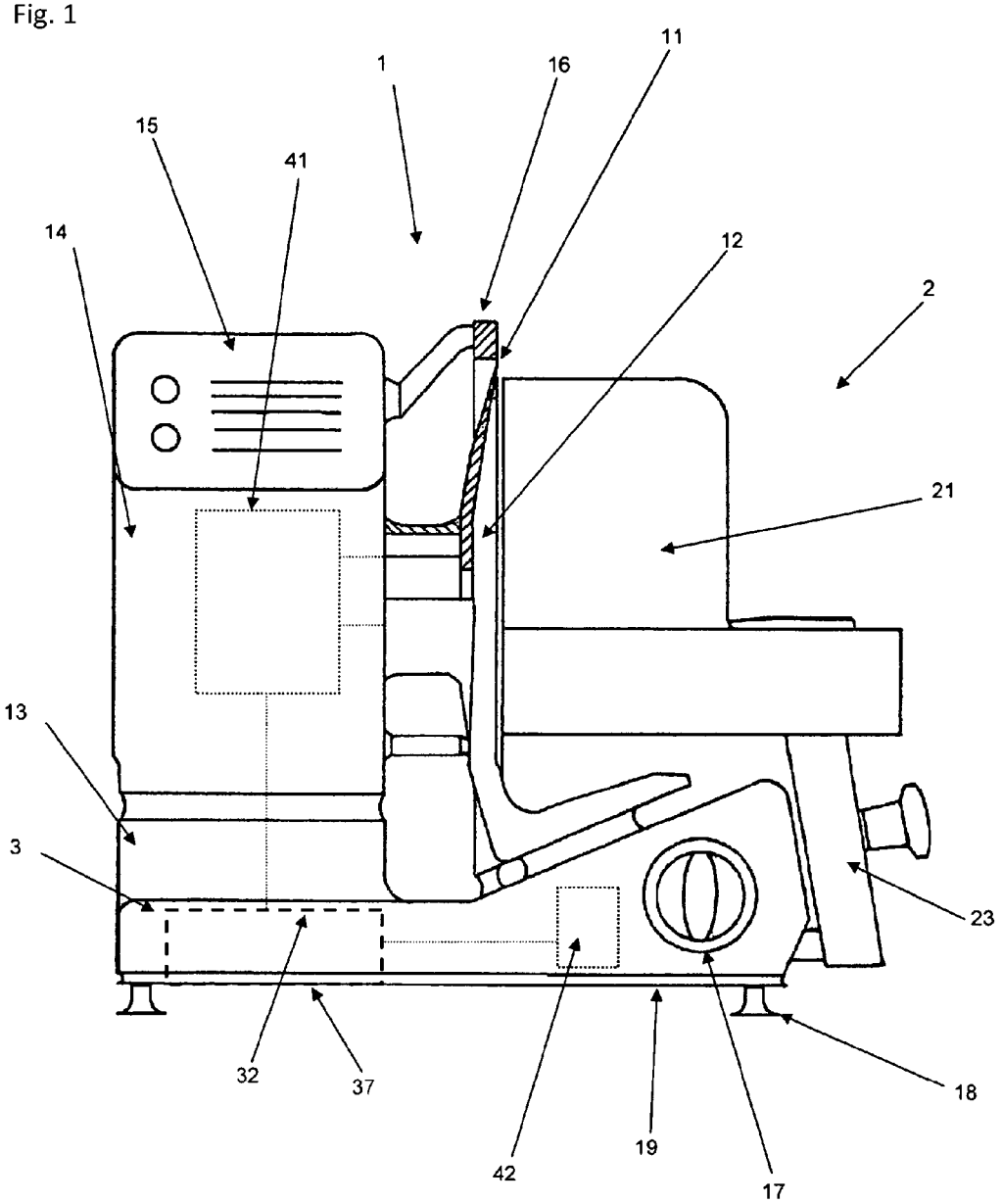
FIG. 1 shows a schematic view of a slicer.

The slicing motor that drives the slicing blade is actuated via a control unit by means of pulse-width-modulated control signals. A microcontroller generates the control signals, sends them to a motor output stage that brings about an output amplification of the signals and forwards them to the slicing motor. During the pulse-width modulation, the frequency and/or the pulse width of the control signals are varied. By the same token, the amplitude of the control signals can be set. The microcontroller, which can have a microprocessor and/or a signal processor, generates the control signals. The control signals can be generated independently of the supply voltage or mains voltage, so that the slicer can be used in power networks all over the world without having to be modified. The control signals are preferably generated by the control unit, preferably as a function of the load status of the motor, so that the power consumption of the motor is adapted to the load status. In this manner, the reactive power of the slicing motor is reduced and thus the generation of heat is diminished. The motor used for the drive of the slicing blade can especially be an asynchronous motor or else a direct-current motor. With an eye towards the adaptation to all kinds of network supply voltages or frequencies, the control unit can have a preferably controlled frequency converter.

In one embodiment, it is provided that the entire control unit, especially the microcontroller and the motor output stage or several motor output stages, are accommodated in a separate housing. The separate control unit housing can be configured to be sealed, especially splash-proof. Slicers have to be cleaned frequently for reasons of hygiene, a process in which water and cleaning agents are used. The tightly encapsulated control unit housing protects the sensitive electronics against mechanical influences brought about by cleaning water or cleaning agents.

In order to nevertheless be able to effectively dissipate waste heat from the closed control unit housing, it is provided that at least one outside wall of the control unit housing is designed as a cooling surface. This cooling surface can be flush with an outside wall of the machine housing of the slicer or else, on the inside, it can lie directly against a heat-conducting outside wall of the machine housing, that is to say, it can be in heat-conducting contact. It is visually and functionally advantageous for the cooling surface to be arranged flush with the bottom of the machine housing.

In order to achieve a good control or regulation of the slicing motor, or else of several motors if there are such, it can be provided for the control unit to have at least one virtual motor model that allows the drive behavior of the motor to be adapted to a specific load status via appropriate parameters. The adaptation is made in that, at a certain operating point, the optimal reactive current component and active current component is determined on the basis of the motor model, after which the appropriate control signals are generated.

It is advantageous for the motor model to be implemented in the control unit as a mathematical or physical model, and for the control unit to calculate the appropriate control signals on the basis of this algorithm. As an alternative, appropriate characteristic values for the motor can be stored in a table or in a matrix and the control unit can then determine the appropriate control signals on the basis of the table.

It is provided that the motor model or the motor models are stored in an electronically rewritable memory device, for example, a flash drive, or a hard drive, and that they can be replaced. In this manner, the drive characteristic of the slicer can be changed or adapted at any time.

In one embodiment, it can be provided that the control unit controls the slicing motor on the basis of prescribed drive curves. Thus, the slicing blade can be started and/or braked on the basis of a defined starting curve or braking curve. Consequently, on the basis of the starting curve, once the drive or the slicing motor has been started, it is possible to reach the target speed as quickly as possible or else the slicing blade can be braked to a standstill as fast as possible once the drive or the slicing motor has been switched off.

Particularly in order to avoid unnecessary operation of the slicer during prolonged interruptions in the slicing work, it can be provided that the control unit detects idling of the slicing motor on the basis of the current consumption and/or of the reactive and active current components, and that it switches off the slicing motor after it has been idling for a given, preferably adjustable, period of time. This dispenses with the need for switching off the drive manually. Moreover, if a user inadvertently forgets to switch off the slicer, this is not a problem since the slicer will automatically switch off after the prescribed period of time. On the one hand, electricity is saved and, on the other hand, the risk of injury is diminished since the slicing blade is not rotating whenever the machine is unattended.

The slicing blade of a slicer has to be sharpened at regular intervals in order to achieve a good slicing result. The operational reliability of the slicer can be improved if the control unit automatically determines the point in time when the slicing blade needs to be sharpened. For this purpose, the control unit can add up the power consumption over time and can activate a maintenance display once a certain threshold has been reached. Here, the slicing operation is preferably determined by the current consumption of the slicing motor, whereby a current consumption above an adjustable threshold is interpreted as the slicing operation. Thus, after a certain period of slicing operation, the control unit can automatically activate the maintenance display. As an alternative, instead of adding up the power consumption, the control unit can also add up the time relating to the operating period of the slicing blade in slicing operation, in order to determine the point in time for the maintenance.

It is advantageous for the control unit to automatically detect a sharpening procedure of the slicing blade on the basis of the course of the power consumption of the slicing motor and to automatically reset the maintenance display after the sharpening procedure has been carried out. When the slicing blade is sharpened, a typical profile of the power consumption is obtained, which the control unit detects, thus recognizing the sharpening procedure.

Wear and tear of the drive system of the slicer that develops slowly over the course of time, for example, due to worn-out bearings, can be recognized in that, periodically over the course of time, the control unit stores the power consumption of the slicing motor when it is idling, so that it detects the increasing wear and tear by comparing the individual values to each other and it then automatically activates a maintenance signal. A slowly rising power consumption is an indicator of increasing wear and tear.

It can be provided, for example, that the control unit measures the idling power consumption of the slicing motor every time it is switched on and continuously stores this information in a memory device. The memory device can be configured as a circulating memory that is dimensioned in such a way that the measurements are continuously stored over a certain period of time of, for instance, 6 months or up to 3 years. At the end of this period of time, the oldest value is then automatically overwritten with the newest measured value.

An application for the slicer is in the food industry or in retail businesses for slicing food such as, for instance, cold cuts, meat, fish, cheese or vegetables.

Additional embodiments of the invention are shown in the figures and described in the appertaining description.

FIG. 1 shows a slicer 1 for slicing food products. The slicer 1 has a housing 13 in which a circular slicing blade 11 and a carriage 2 that can be moved back and forth by a motor are mounted. The carriage forms a support for the cut food products. The slicer can be set up on a flat substrate by feet 18 installed on the bottom of the machine housing.

The bottom of the housing 13 is covered by a removable bottom tray 19 so as to be splash-proof. Behind the bottom tray, there is an installation space in the housing 13 which accommodates a carriage motor 42 for driving the carriage 2 that is secured by the carriage foot 23 as well as a control unit 3 situated in its own sealed control unit housing 32. The bottom of the control unit housing 32 has a cooling surface 37 that engages into an opening in the bottom tray 19 so as to be sealed and that dissipates waste heat of the control unit 3 downwards. The cooling surface 37 is flush with the bottom of the bottom tray 19 and dissipates the heat to the surroundings via a metallic surface made, for example, of aluminum or copper.

The machine housing 13 also has a stop plate 12 that serves for setting the slicing thickness of the food slices that are to be cut. The stop plate 12 runs parallel to the slicing blade 11, or to the slicing plane defined by the slicing blade, thus forming a stop for the food products placed onto the carriage 2. A knob 17 can be used to adjust the stop plate 12 parallel to the slicing plane defined by the slicing blade 11 in order to adjust the cutting thickness and thus the thickness of the slices of food.

A motor tower 14 holds a slicing motor 41 that drives the slicing blade 11 and thus causes it to rotate. An operating panel 15 arranged on the motor tower 14 can be used to operate the slicer 1. On the circumference of the slicing blade 11, there is a cutting edge that is covered by a blade protection ring 16 that is firmly joined to the housing 13. For purposes of injury prevention, the blade protection ring 22 surrounds the cutting edge in a C-shaped manner and leaves only a small front area of the cutting edge free for cutting purposes.

Figure 2:
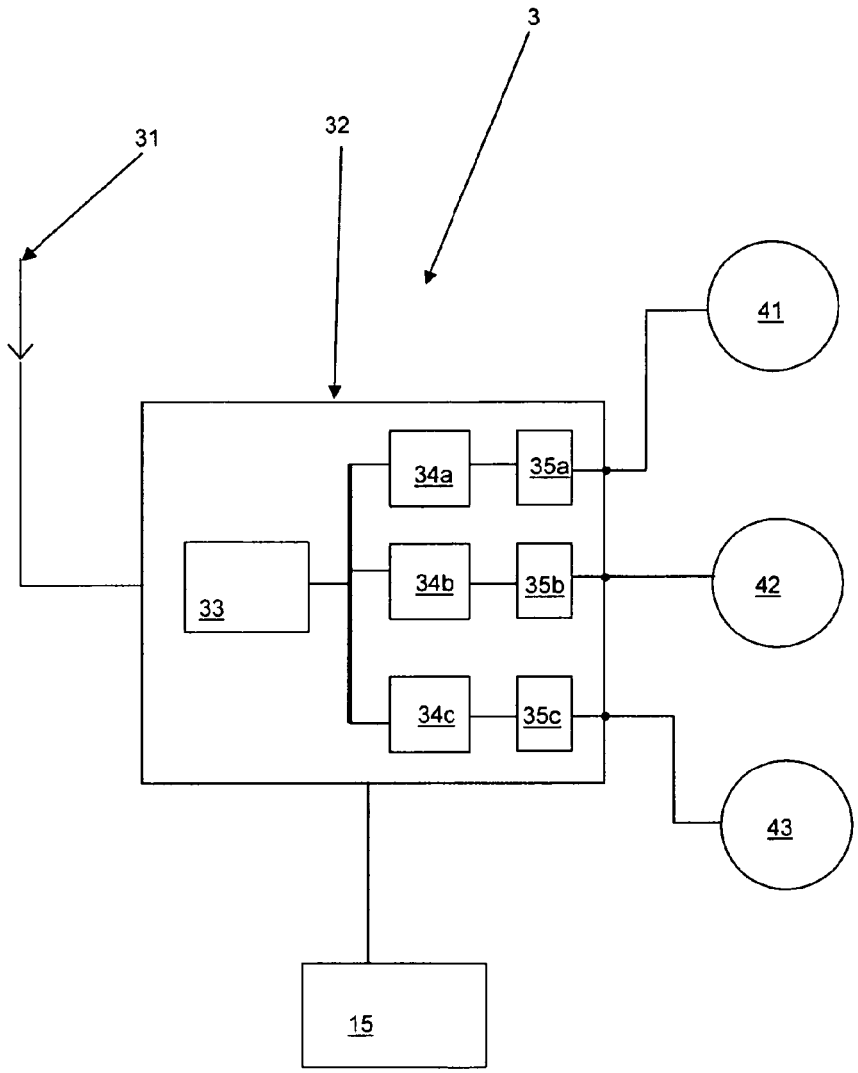
FIG. 2 shows a schematic view of the control of the slicer.

FIG. 2 shows a schematic overview of the control unit 3. The control unit is connected to a power network via a power line 31. The control unit housing 32 comprises a microcontroller, as well as motor output stages 34*a*, 34*b* and 34*c*, and filters for suppressing interfering radiation 35*a*, 35*b* and 35*c*. The microcontroller comprises a microprocessor and memory modules, especially non-volatile flash drives.

The control unit 3 controls three motors, namely, a slicing motor 41, a carriage motor 42 and a product feed motor 43. Each motor has its own signal path. By way of example for the slicing motor, this signal path runs from the microcontroller 33 past a motor output stage 34*a*, a filter 35*a* and on to the slicing motor 41. The one microcontroller 33 controls all of the motors. This has the advantage that additional devices for synchronizing the drives can be dispensed with since the microcontroller 33 controls the carriage motor 42 and the product feed motor 43 and can thus synchronize these drives directly with each other without additional communication paths being needed. The cabling between the control unit housing 32 and the motors is shielded in order to largely suppress the emission of noise signals. The control unit 3 is connected to an operating and display unit 15 via an interface by means of which the slicer can be operated.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

The invention claimed is:

1. A slicer for cutting slices of an elongated food product, the slicer comprising:

a machine housing;

a circular slicing blade held by the machine housing;

a carriage configured to move back and forth with respect to the machine housing and to carry the elongated food product;

a stop plate configured to set a slicing thickness of the elongated food product disposed on the carriage;

an asynchronous electric slicing motor that rotates the circular slicing blade;

a control unit that actuates the asynchronous electric slicing motor using a pulse-width modulation, the control unit including a microcontroller and a first motor output stage connected to the asynchronous electric slicing motor, wherein the microcontroller is configured to generate pulse-width-modulated control signals by varying at least one of an amplitude, a frequency, or a pulse width of the control signals as a function of a load status of the asynchronous electric slicing motor, and wherein the first motor output stage is configured to forward the control signals to the asynchronous electric slicing motor to rotate the circular slicing blade.

2. The slicer recited in claim 1, wherein the microcontroller and motor output stage are accommodated in a separate control unit housing, the control unit housing being configured to be splash-proof and being replaceably disposed in the machine housing.

3. The slicer recited in claim 2, wherein the control unit housing includes an outer wall that is configured as a cooling surface, the outer wall being arranged on an outside of the machine housing.

4. The slicer recited in claim 3, wherein the outer wall is disposed at a bottom of the machine housing.

5. The slicer recited in claim 1, wherein the control unit includes a filter circuit disposed between the motor outputs stage and the slicing motor, the filter circuit being configured to suppress electromagnetic interferences.

6. The slicer recited in claim 1, further comprising at least one additional electric motor, wherein the microcontroller actuates a motor output stage of the at least one additional electric motor in addition to the slicing motor output stage.

7. The slicer recited in claim 6, wherein the at least one additional electric motor includes at least one of a carriage motor, a product feed motor and a transport device motor.

8. The slicer recited in claim 1, wherein the microcontroller, the motor output stage of the slicing motor, and the motor output stage of the at least one additional electric motor are disposed in a control unit housing.

9. The slicer recited in claim 1, wherein the control unit includes at least one motor model and is configured to regulate an operating point of the asynchronous electric slicing motor so as to adapt a momentary reactive current component and an active current component drawn by the asynchronous electric slicing motor for a desired operating point.

10. The slicer recited in claim 9, wherein the control unit includes a motor model as an algorithm that is configured to calculate a reactive current component and an active current component required for a desired operating point based on the algorithm.

11. The slicer recited in claim 9, wherein the control unit includes a motor model as a table containing motor characteristic values and is configured to determine a reactive current component and an active current component for a desired operating point based on the table.

12. The slicer recited in claim 9, wherein the control unit stores the at least one motor model in a non-volatile, rewriteable memory device, and wherein the at least one motor model is replaceable or changeable.

13. The slicer recited in claim 1, wherein the control unit is configured to control or regulate at least one of a start and a braking behavior of the slicing motor based on a starting curve or braking curve.

14. The slicer recited in claim 1, wherein the control unit is configured to detect idling of the asynchronous electric slicing motor based on at least one of a current consumption, a reactive current component, or an active current component, and is configured to switch off the asynchronous electric slicing motor after it has been idling for a given period of time.

15. The slicer recited in claim 1, wherein the control unit is configured to determine a maintenance point in time when the slicing blade needs to be sharpened by adding a power consumption of the slicing motor over time, or by determining a total operating duration in slicing operation, and is configured to activate a maintenance display once a certain threshold has been reached.

16. The slicer recited in claim 1, wherein the control unit is configured to detect a sharpening procedure of the slicing blade based on a course of power consumption of the slicing motor and is configured to automatically reset a maintenance display upon detection of the sharpening procedure.

17. The slicer recited in claim 1, wherein the control unit includes a memory device and is configured to store a power consumption, over time, of the slicing motor when it is idling so as to detect possible wear and tear, and so as to activate a maintenance signal.

18. The slicer recited in claim 1, further comprising:

a carriage motor that moves a carriage for supporting the slices of the elongated food products; and a product feed motor that feeds the elongated food products toward the circular slicing blade;

wherein the control unit actuates the carriage motor and the product feed motor using a pulse-width modulation, the control unit including a second motor output stage connected to the carriage motor and a third motor output stage connected to the product feed motor.

19. The slicer recited in claim 18, wherein the second and third motor output stages are configured to forward the control signals to the carriage motor and the product feed motor, respectively.

* * * * *